US007240883B2

(12) United States Patent
Liao

(10) Patent No.: US 7,240,883 B2
(45) Date of Patent: Jul. 10, 2007

(54) HEAD MOUNT LAMP SEAT

(76) Inventor: Su-Chang Liao, 235 Chung - Ho Box 8-24, Taipei (TW)

( * ) Notice: Subject to any disclaimer, the term of this patent is extended or adjusted under 35 U.S.C. 154(b) by 66 days.

(21) Appl. No.: 11/207,958

(22) Filed: Aug. 22, 2005

(65) Prior Publication Data

US 2007/0040086 A1 Feb. 22, 2007

(51) Int. Cl.
*E04G 3/00* (2006.01)

(52) U.S. Cl. ..... 248/278.1; 362/106

(58) Field of Classification Search ..... 248/278.1, 248/276.1, 280.11, 479; 362/106
See application file for complete search history.

(56) References Cited

U.S. PATENT DOCUMENTS 2,421,643 A * 6/1947 Ostli ..... 362/106
3,133,705 A * 5/1964 Eickelman ..... 362/106
4,991,068 A * 2/1991 Mickey ..... 362/106
5,359,501 A * 10/1994 Stevens ..... 362/108
5,541,816 A * 7/1996 Miserendino ..... 362/106
5,667,291 A * 9/1997 Caplan et al. ..... 362/105
5,676,449 A * 10/1997 Newsome ..... 362/106
6,616,293 B2 * 9/2003 Mickey ..... 362/106
2006/0131467 A1 * 6/2006 Wang ..... 248/276.1

* cited by examiner

*Primary Examiner*—Ramon O Ramireez

(57) ABSTRACT

A head mount lamp seat comprises a pivotal unit, a movable unit and a rotary unit; wherein the movable unit is rotatably connected to one end of the pivotal unit; and another end of the pivotal unit is rotatably connected to the rotary unit; and a lamp is installed to the rotary unit. The rotary unit is rotatable horizontally with respect to the another end of the movable unit.

1 Claim, 9 Drawing Sheets

HEAD MOUNT LAMP SEAT

FIELD OF THE INVENTION

The present invention relates to lamps, and in particular to a head mount lamp seat comprises a pivotal unit, a movable unit and a rotary unit; wherein the movable unit is rotatably connected to one end of the pivotal unit; and another end of the pivotal unit is rotatably connected to the rotary unit. A lamp is installed to the rotary unit. The rotary unit is rotatable horizontally with respect to another end of the movable unit.

BACKGROUND OF THE INVENTION

Referring to FIG. 9, a conventional head mount lamp seat is illustrated. The prior art has a pivotal unit 81 and a retaining strip 14. A lamp 82 is fixed to a cap 91. The cap 91 is worn by people. In the prior art, the lamp 82 is only adjustable within a small range to a fourth position P4. It cannot be adjusted rightwards or leftwards or rearwards. Thereby the use of the prior art head mount lamp seat is limited.

SUMMARY OF THE INVENTION

Accordingly, the primary object of the present invention is to provide a head mount lamp seat which comprises a pivotal unit, a movable unit and a rotary unit; wherein the movable unit is rotatably connected to one end of the pivotal unit; and another end of the pivotal unit is rotatably connected to the rotary unit; a lamp is installed to the rotary unit; the rotary unit is rotatable horizontally with respect to the another end of the movable unit.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
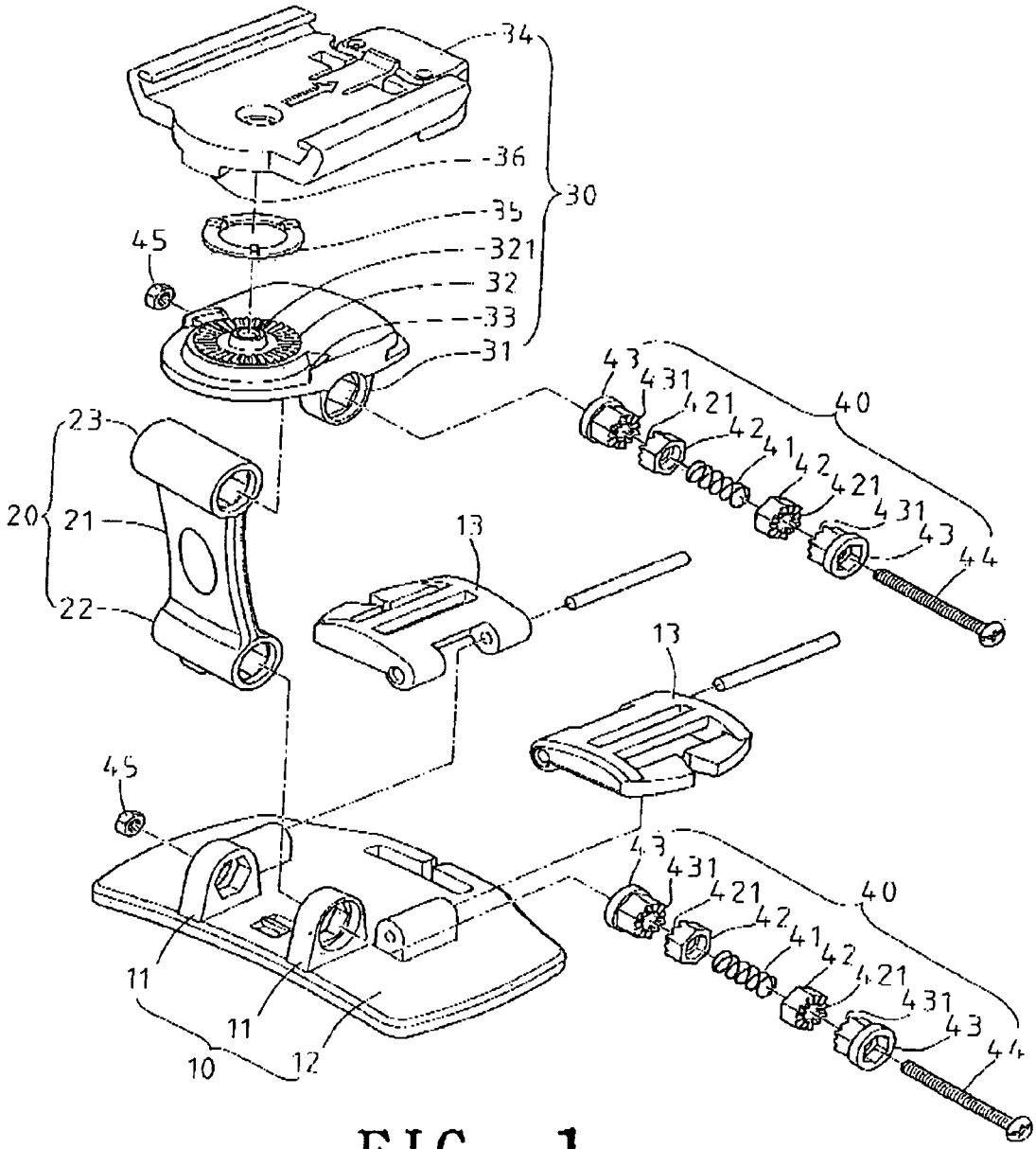
FIG. 1 is an exploded perspective view of the present invention.
Figure 2:
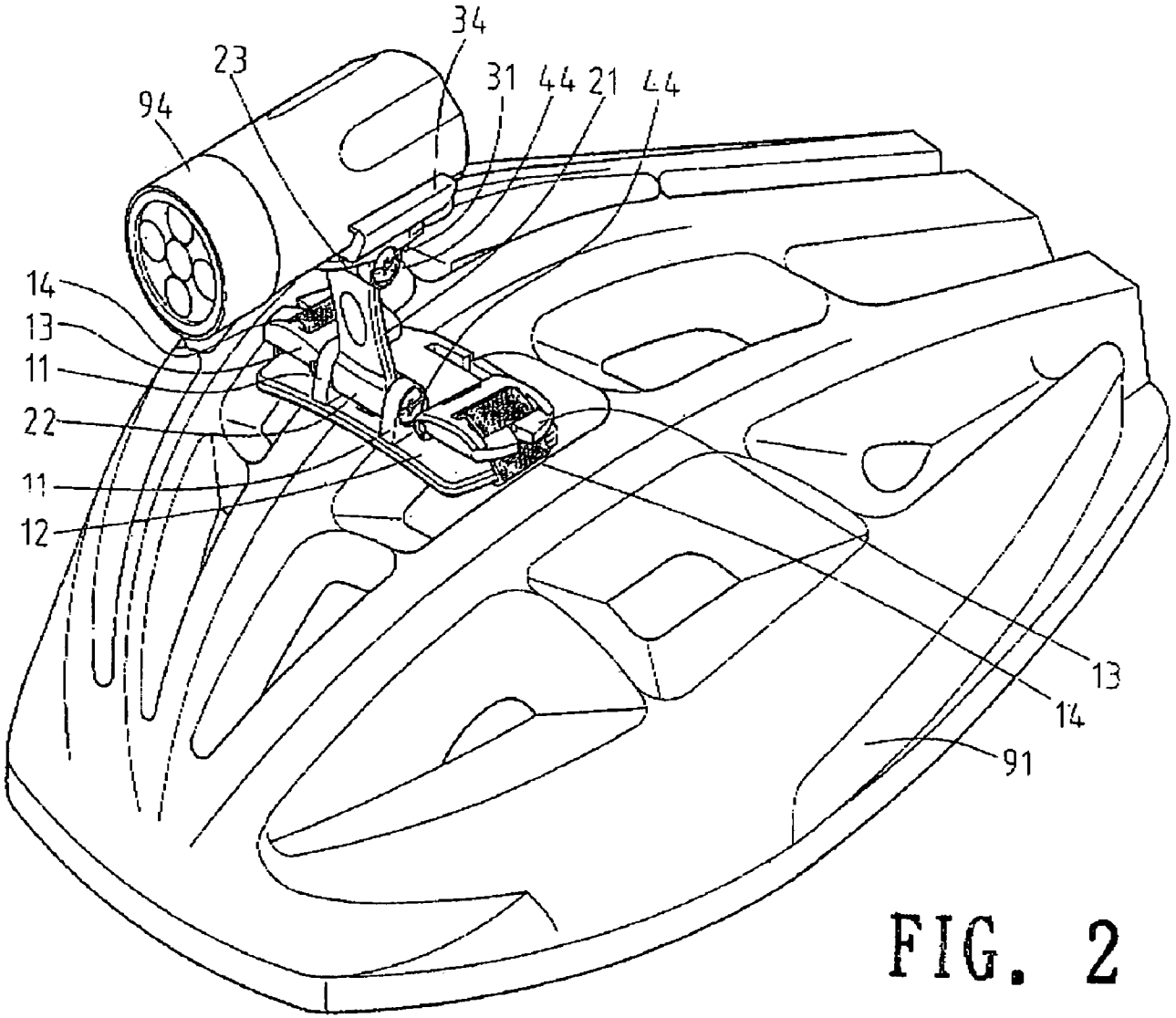
FIG. 2 is a schematic view about the first embodiment of the present invention.
Figure 3:
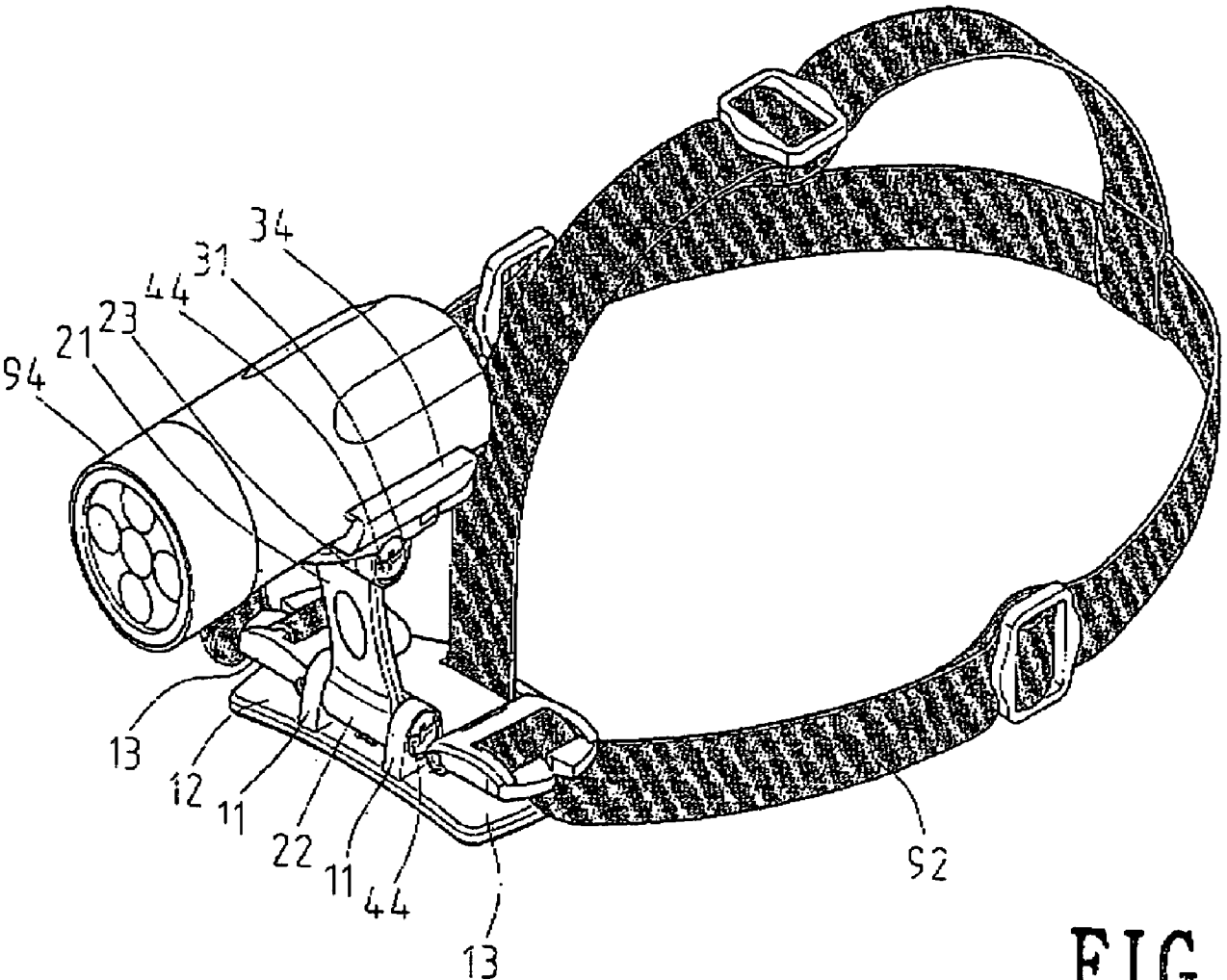
FIG. 3 is a schematic view about the second embodiment of the present invention.

With reference to FIGS. 1, 2 and 3, the head mount lamp seat of the present invention is illustrated. The present invention has the following elements.

A pivotal unit 10 has the following elements.

A pivotal element 11 is included. In this the present invention, preferably, the pivotal unit 10 is a pair of pivotal ear portion.

Figure 8:
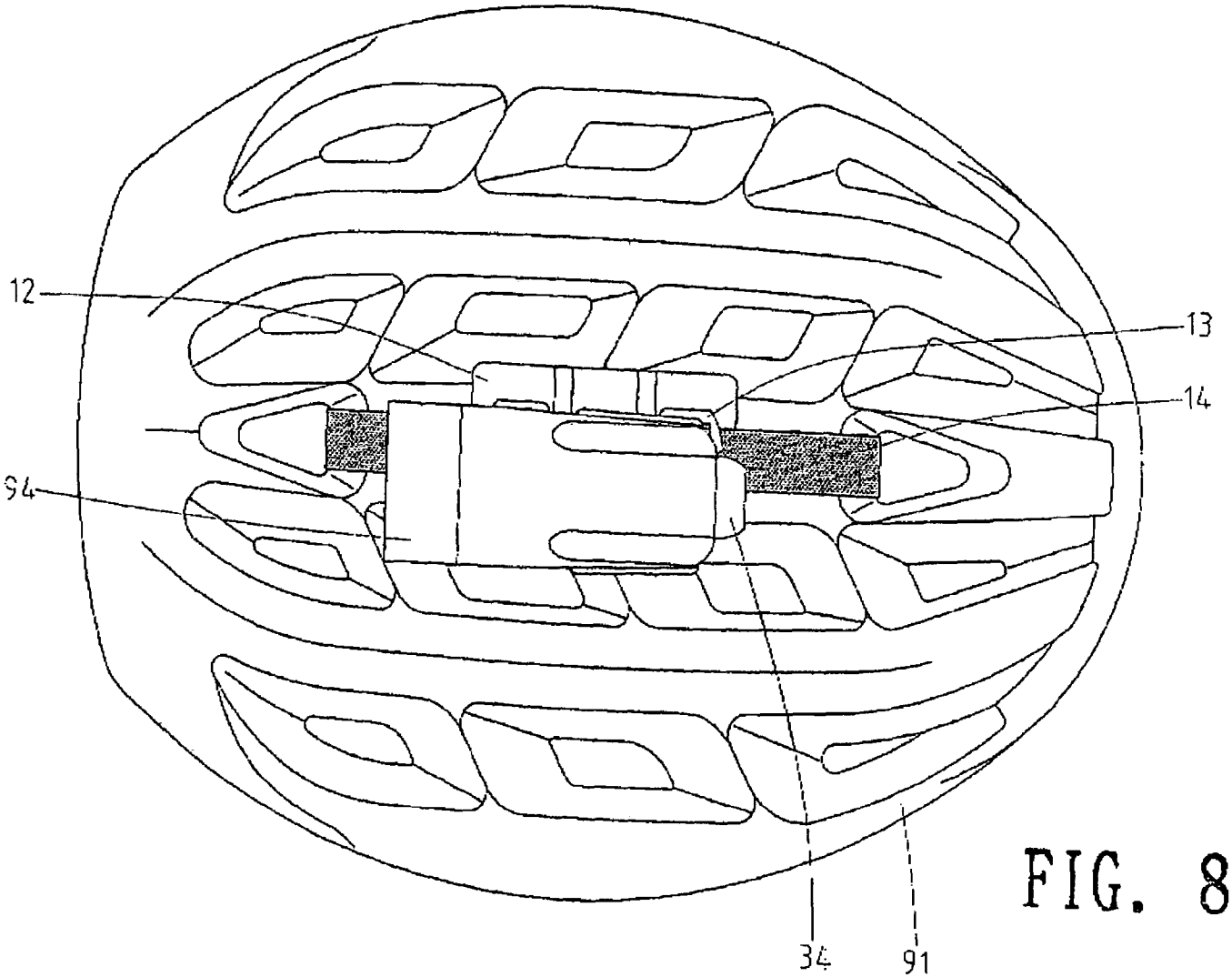
FIG. 8 is a schematic view of the third embodiment of the present invention.
Figure 9:
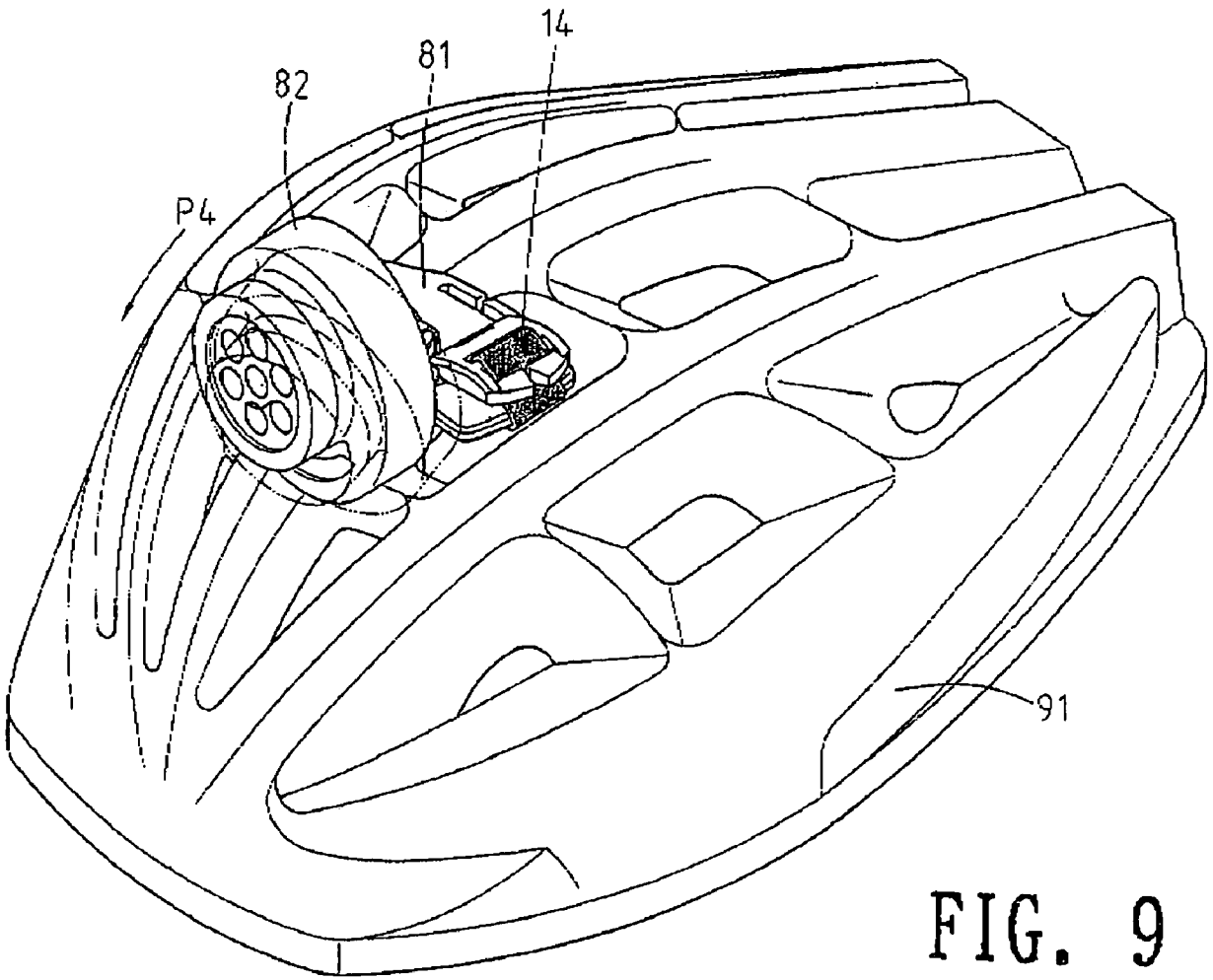
FIG. 9 (PRIOR ART)
FIG. 9 is a schematic view of a prior art structure.

A connecting seat 12 serves for fixing the pivotal element 11 and for connecting a cap 91 or a head mount 92 (referring to FIG. 8). The connecting seat 12 is formed with a pair of connecting ears 13. A retaining strip 14 passes through the connecting ears 13 so that the pivotal unit 10 can retain the cap 91 or the head mount 92 rapidly.

A movable unit 20 includes the following element:

A connecting sheet 21 has two ends.

A first movably portion 22 is installed at one end of the rod 21.

The first movably portion 22 has an approximate round shape. The first movably portion 22 is pivotally installed to the pivotal element 11 so that the movable unit 20 is pivoted to the pivotal unit 10 by the pivotal element 11.

A first retaining unit 40 is installed to the first movably portion 22. The first retaining unit 40 has the following elements.

A spring 41 is included.

Two first teeth disks 42 are installed to two ends of the spring 41. Each first teeth disk 42 has a first teeth portion 421 facing toward the spring 41.

Two second teeth disks 43 are installed at outer sides of the two first teeth disks 43. Each second teeth disk 43 has a second teeth portion 431 facing toward the first teeth disk 42.

A stud 44 passes through the pivotal element 11, the spring 41, the two first teeth disks 42 and the two second teeth disks 43. A nut 45 screws with the stud 44 so as to compress the pivotal element 11, spring 41, two first teeth disks 43 and two second teeth disks 43. Thereby the first teeth disks 42 are engaged to the second teeth disks 43.

A second movable portion 23 is installed at another end of the connecting sheet 21. The second movable portion 23 has an approximate round shape. A second retaining unit 40 is installed to the second movable portion 23. The structure of second retaining unit 40 is identical to the first retaining unit 40.

A rotary unit 30 is included. The second movable portion 23 serves to make the movable unit 20 to swing along the rotary unit 30. The rotary unit 30 has the following elements.

A body is included.

A pivotal portion 31 is included. In this embodiment, the pivotal portion is a pair of pivotal ears. Thereby the rotary unit 30 can be installed to the second movable portion 23.

A rotary teeth surface 32 protrudes from the body and has an axial hole 321.

A sliding path 33 is a concave path in the body and arranged approximately around the rotary teeth surface 32.

A retaining seat 34 serves for connecting a lamp 94.

A fixed teeth surface 35 is corresponding to the rotary teeth surface 32. The fixed teeth surface 35 is installed below the retaining seat 34 and around the axial hole 321. Thereby the retaining seat 34 is rotatable continuously or step by step with respect to the rotary teeth surface 32.

An auxiliary unit 36 is installed below the retaining seat 34 with respect to the sliding path 33.

Figure 4:
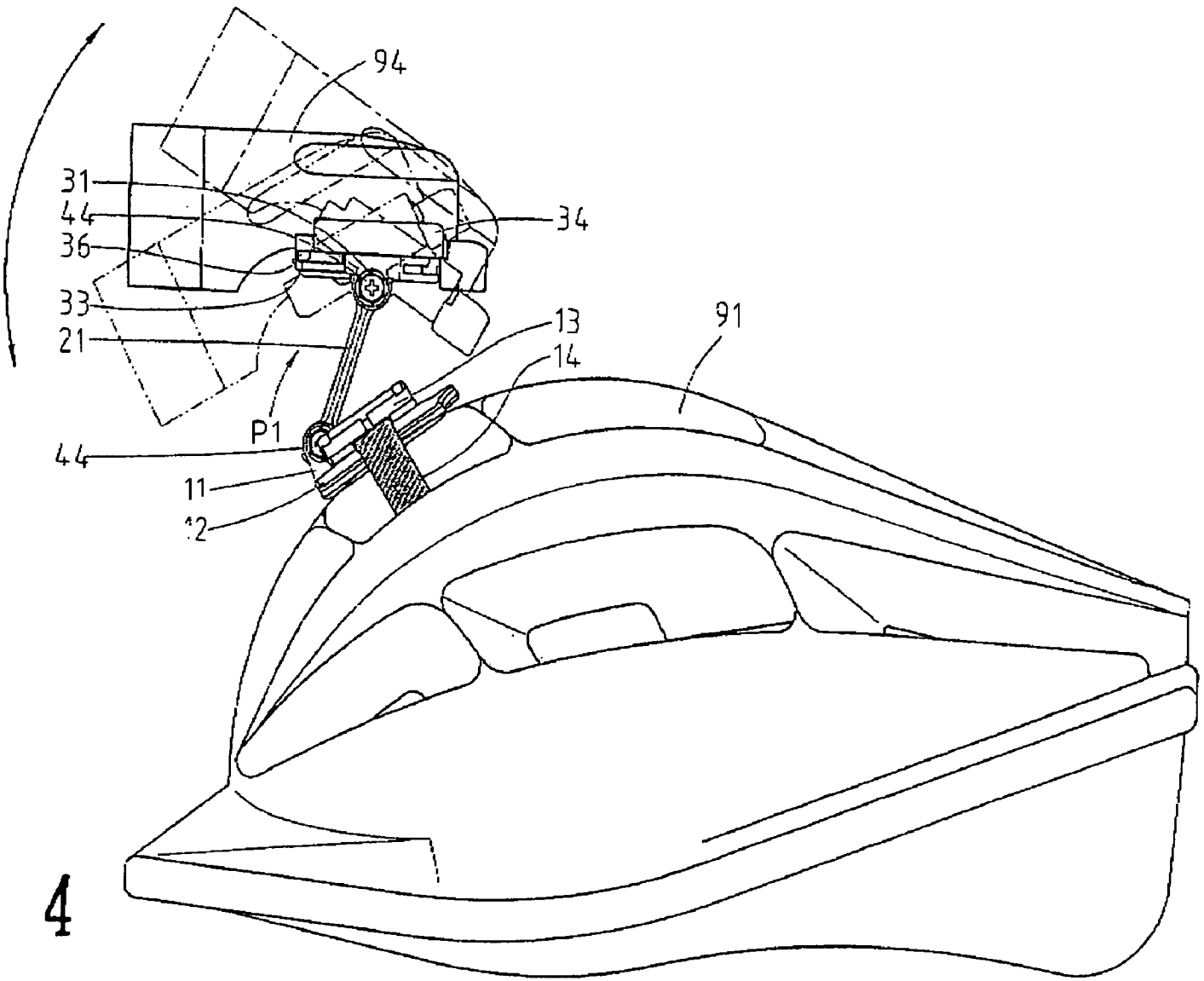
FIG. 4 is a first schematic view showing the operation of FIG. 2.

Referring to FIG. 4, the movable unit 20 swings to a first position P1 around the pivotal element 11 of the pivotal unit 10 by the first movably portion 22 thereof. The pivotal portion 31 of the rotary unit 30 is rotatable around 360 degrees around the second movable portion 23 of the movable unit 20. The headlight 94 at the first position can illuminate from the front end to the rear end (the rotation range can be greater than that illustrated in the drawings).

Figure 5:
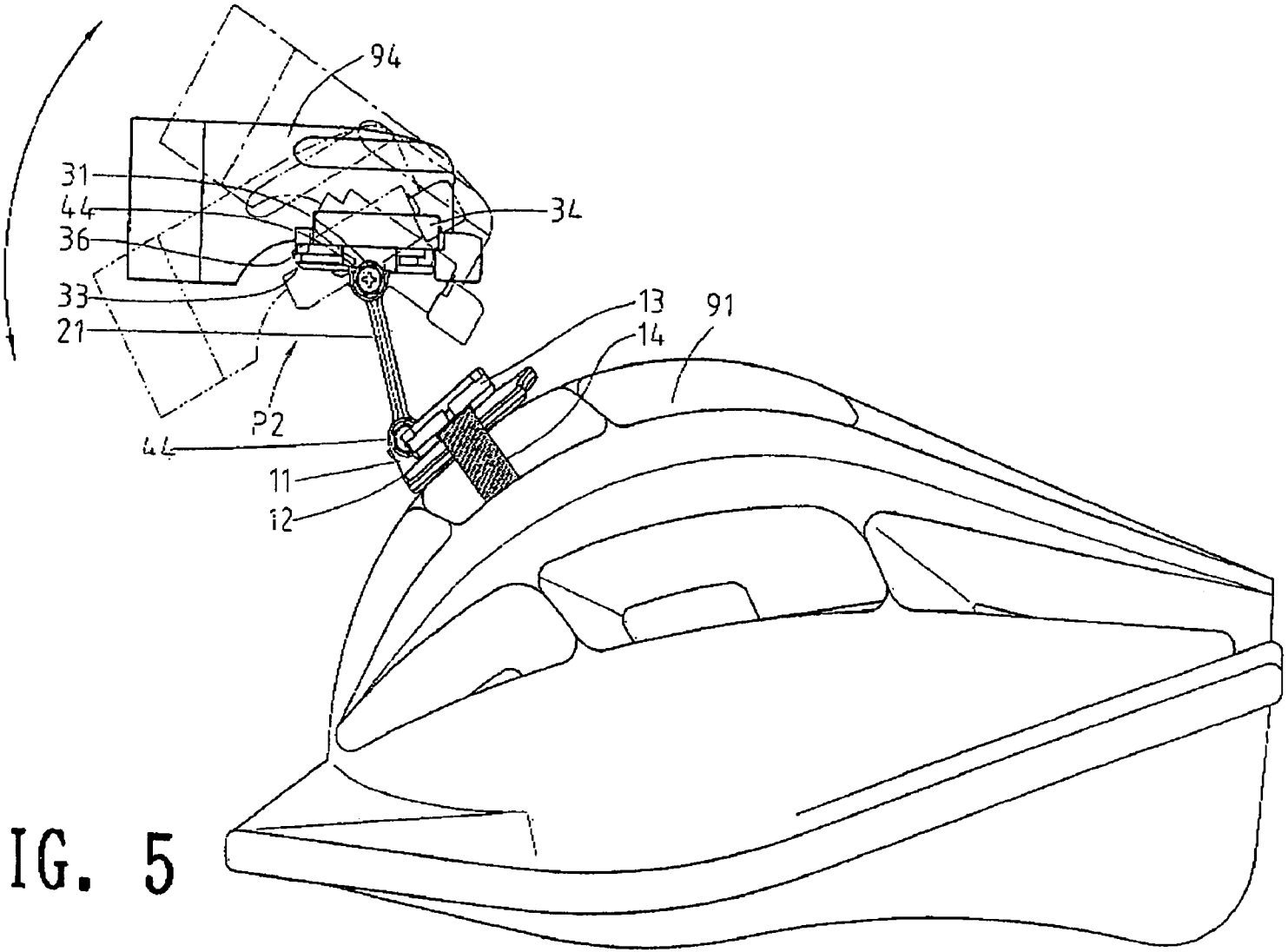
FIG. 5 is a second schematic view about the operation of FIG. 2.

Referring to FIG. 5, the movable unit 20 swings to a second position P2 from the first position P1, the pivotal portion 31 of the rotary unit 30 is rotatable around 360 degrees around the second movable portion 23 of the movable unit 20. Thereby by adjusting the movable unit 20, the headlight 94 can move forwards so as to illuminate farther places. In the second position P2, the headlight 94 can illuminate from the front end to the rear end (the rotation range can be greater than that illustrated in the drawings).

Figure 6:
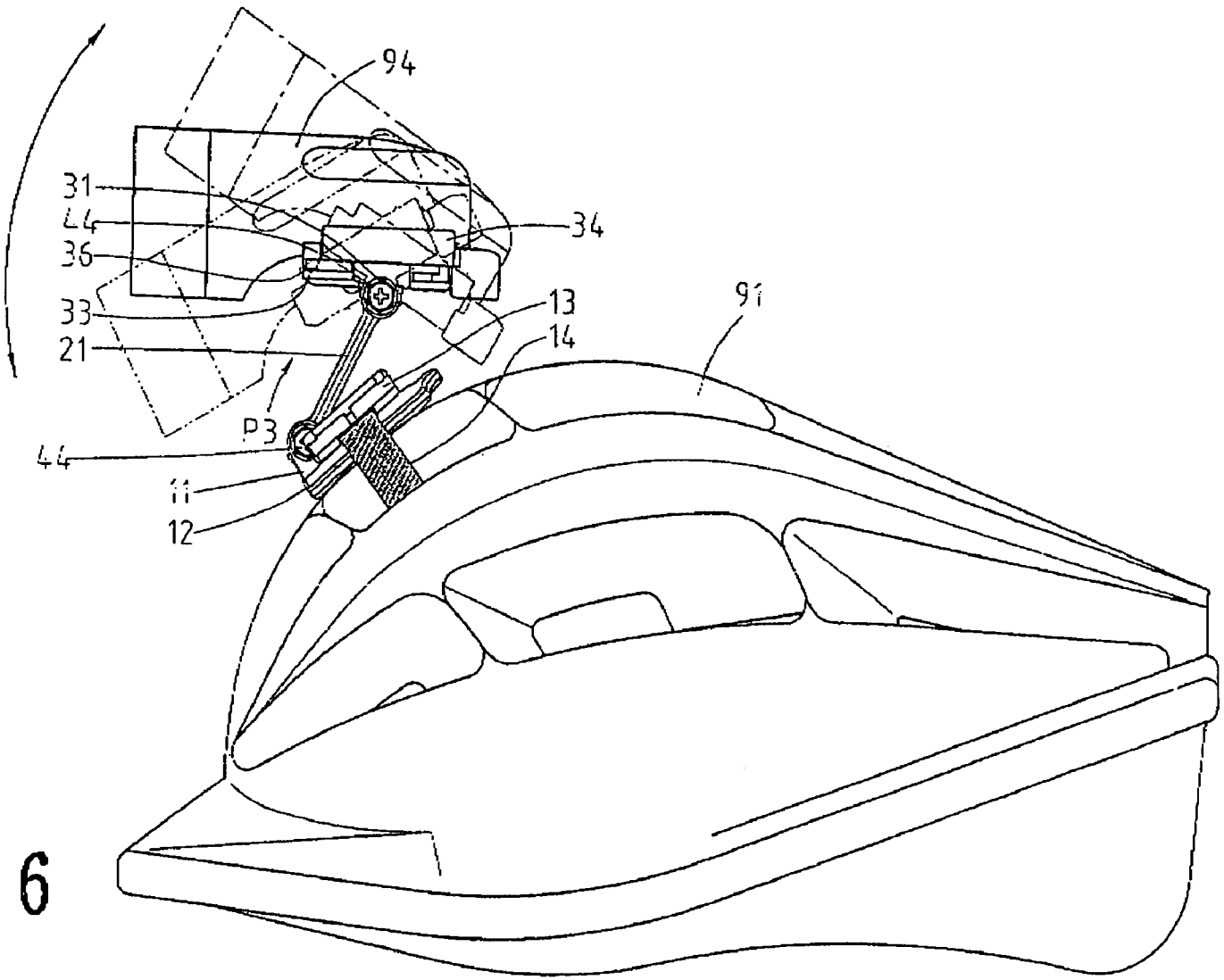
FIG. 6 is a third schematic view about the operation of FIG. 2.

Referring to FIG. 6, when the movable unit 20 swings to a third position P3 from the second position P2, the pivotal portion 31 of the rotary unit 30 is rotatable through 360 degrees around the second movable portion 23 of the movable unit 20. In the third position P3, the headlight 94 is placed at a near place. In the second position P3, the headlight 94 can illuminate from the front end to the rear end (the rotation range can be greater than that illustrated in the drawings).

Figure 7:
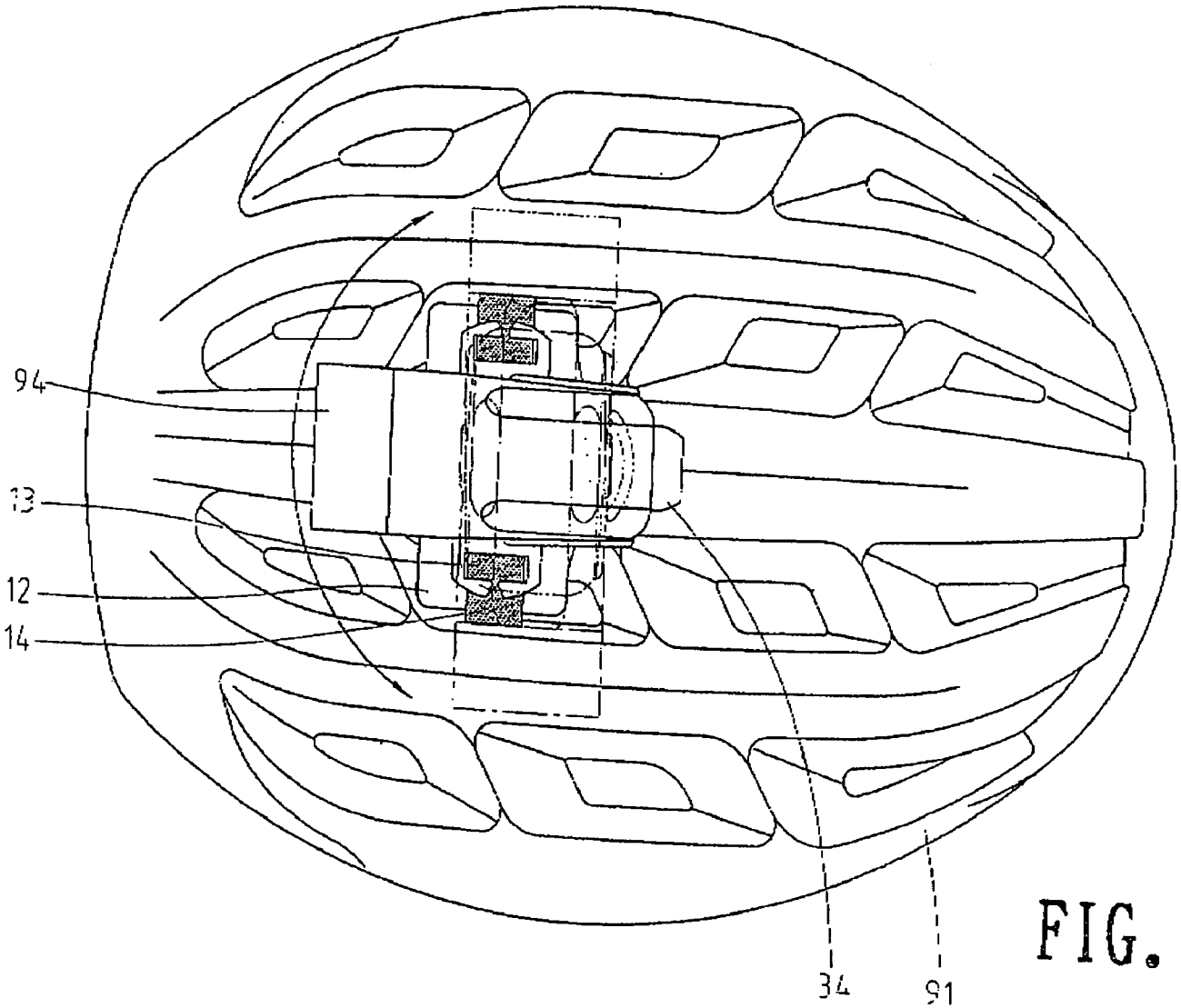
FIG. 7 is a fourth schematic view about the operation of FIG. 2.

Referring to FIG. 7, when the movable unit 20 swings to any position around the first movably portion 22 on the pivotal element 11 of the pivotal unit 10, the fixed teeth surface 35 and the auxiliary unit 36 are rotatable horizontally. The headlamp 94 is driven to rotate horizontally through 360 degrees on the pivotal unit 10. The illumination range is from left to right, from near side to far side.

Thereby as shown in FIGS. 3 and 8, the rotary seat 34 is transversally fixed to the cap 91, which can be adjusted to have will illumination range as a ball surface.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A head mount lamp seat comprising:

a pivotal unit comprising:

a pivotal clement;

a connecting seat for fixing the pivotal element and for connecting a cap or a head mount; the connecting seat being formed with a pair of connecting ears; a retaining strip passing through the connecting ears so that the pivotal unit can retain the cap the head mount rapidly;

a movable unit comprising:

a connecting sheet having two ends, a first movably portion installed at one end of the rod, the first movably portion having an approximate round shape; the first movably portion being pivotally installed to the pivotal element so that the movable unit is pivoted to the pivotal unit by the pivotal element;

a first retaining unit being installed to the first movably portion;

a second movable portion being installed at another end of the connecting sheet; the second movable portion having an approximate round shape; a second retaining unit being installed to the second movable portion;

each of the first retaining unit and the second retaining unit comprising:

a spring;

two first teeth disks installed to two ends of the spring; each first teeth disk having a first teeth portion facing toward the spring;

two second teeth disks installed to outer sides of the two first teeth disks; each second teeth disk having a second teeth portion facing toward the first teeth disk;

a stud passing through the pivotal element, the spring, the two first teeth disks and the two second teeth disks; a nut screwing with the stud so as to compress the pivotal element, spring, two first teeth disks and two second teeth disks; thereby the first teeth disks being engaged to the second teeth disks:

a rotary unit; the second movable portion serving to make the movable unit to swing along the rotary unit; the rotary unit comprising:

a body;

a pivotal portion for installing the rotary unit to the second movable portion;

a rotary teeth surface protruded from the body and having an axial hole;

a sliding path being a concave path in the body and arranged approximately around the rotary teeth surface;

a retaining seat for connecting a lamp;

a fixed teeth surface corresponding to the rotary teeth surface; the fixed teeth surface being installed below the retaining seat and around the axial hole; thereby the retaining seat being rotatable continuously or step by step with respect to the rotary teeth surface; and an auxiliary unit being installed below the retaining seat with respect to the sliding path.

* * * * *